US005181782A

United States Patent [19]

Wojcik

[11] Patent Number: 5,181,782

[45] Date of Patent: Jan. 26, 1993

[54] TELESCOPIC RAIL WITH LOCKING MECHANISM

[75] Inventor: Thadeus H. Wojcik, Eijsden, Netherlands

[73] Assignee: Thomas Regout N.V., Maastricht, Netherlands

[21] Appl. No.: 755,327

[22] Filed: Sep. 5, 1991

[30] Foreign Application Priority Data

Sep. 6, 1990 [NL] Netherlands ..... 9001969

[51] Int. Cl.[5] ..... F16C 29.04; A47B 88/00

[52] U.S. Cl. ..... 384/21; 312/334.44; 384/18

[58] Field of Search ..... 384/18-21, 384/49, 50, 51; 312/348, 333

[56] References Cited

U.S. PATENT DOCUMENTS

| | | | |
|---|---|---|---|
| 3,039,838 | 6/1962 | Koch, Jr. et al. | 312/348 X |
| 4,469,384 | 9/1984 | Fler et al. | 384/18 |
| 4,932,792 | 6/1990 | Baxter | 384/18 |

FOREIGN PATENT DOCUMENTS

| | | |
|---|---|---|
| 1125346 | 8/1982 | Canada . |
| 3005817 | 9/1980 | Fed. Rep. of Germany . |

*Primary Examiner*—Thomas R. Hannon

*Attorney, Agent, or Firm*—Weingarten, Schurgin, Gagnebin & Hayes

[57] ABSTRACT

A telescopic rail mainly consisting of three, substantially C-shaped sections of which the inner or drawer section (3) is slidably mounted in the intermediate section (2) with interposition of a first ball cage and the intermediate section (2) is slidably mounted in the outer or cabinet section (1) with interposition of a second ball cage (7). Mounted at one end of the intermediate section (2) is a stop block (5) with resilient fingers (13) which can be brought into a coupling position wherein the inner section (3) is coupled to the intermediate section (2) and into a pass position wherein the inner section (3) can move independently of the intermediate section (2). The inner section (3) at one end thereof is provided with inwardly pointing projections (11) facing each other, which can cooperate with outwardlly pointing projections (12) facing away from each other, provided on the resilient fingers (13) of the stop block (5), which projections (12) in the coupled position of the sections are disposed in the path of travel of the projections (11) of the inner section (3). Arranged between the free ends of the resilient fingers (13) is a locking member (6) which can be moved in the axial direction of the telescopic rail.

7 Claims, 4 Drawing Sheets

TELESCOPIC RAIL WITH LOCKING MECHANISM

This invention relates to a telescopic rail, mainly consisting of three, substantially C-shaped sections of which the inner or drawer section is slidably mounted in the intermediate section with interposition of a first ball cage and the intermediate section is slidably mounted in the outer or cabinet section with interposition of a second ball cage, there being mounted at one end of the intermediate section a stop block with resilient fingers, which fingers can be brought into a coupling position wherein the inner section is coupled to the intermediate section and into a pass position wherein the inner section can move independently of the intermediate section.

Such a telescopic rail is known from Canadian patent specification 1,125,346. The stop block fitted with resilient fingers and mounted on the intermediate section ensures that, at least during the first part of the extension movement of a drawer connected to the inner section, the intermediate section is coupled to the inner section, while the inner section is not displaced relative to the intermediate section until the intermediate section has reached the end of its path of extension.

The stop block consists of an elastomeric material. The resilient fingers thereof embrace an arrow-shaped member mounted on the inner section. This arrow-shaped member can disengage from the embrace of the resilient fingers only when these fingers are pushed apart by a second identically shaped arrow-shaped member. This second arrow-shaped member is mounted at one end of the ball cage mounted between the cabinet section and the intermediate section. The resilient fingers of the elastomeric stop block are retained in the coupling position by virtue of their elasticity and in the pass position are forced to move outwardly.

The telescopic rails used for desk drawers and the like must be capable of tolerating many thousands of extension and retraction movements. A drawback of the stop block of elastomeric material is that in the course of time it loses its resilience, so that the arrow-shaped member of the inner section is embraced insufficiently, with the result that a coupled movement of the inner and the intermediate section is no longer possible.

A second drawback of the stop block resides in the fact that it cannot fulfill any function in taking up the rebounding movement which occurs upon closing a relatively heavy desk drawer.

It is an object of the invention to overcome these drawbacks and to provide a telescopic rail of the type described hereinabove, which can tolerate the required multiplicity of extension and retraction movements and moreover can prevent the rebounding of the drawer when it is being closed.

According to the invention, this object is accomplished by providing a telescopic rail wherein the inner section at one end thereof is provided with inwardly pointing projections facing each other, while the resilient fingers of the stop block are fitted with outwardly pointing projections facing away from each other, which projections can be brought into the coupling position by means of a locking member adapted to be slid between the free ends of the resilient fingers, in which coupling position the projections of the resilient fingers are disposed in the path of travel of the projections of the inner section.

In the coupling position, the compression of the resilient fingers is prevented by the locking member, i.e. in that position the stop block is rigid in form. Compression of the resilient fingers does not occur until the telescopic rail moves from the coupling position into the pass position wherein the stop block is not required to retain any member but the projections of the inner section merely need to push the resilient fingers towards each other. The elasticity of the resilient fingers, therefore, does not fulfill any function in the coupling position as it does in the above described known telescopic rail.

It is noted that it is known from DE-OS 30.05.817 to provide the intermediate section of a telescopic rail at one end thereof with inwardly pointing projections facing each other, which projections can cooperate with a rubber or plastics retaining member mounted at the end of the outer section for receiving, under damping, a drawer connected to the telescopic rail and retaining the same in the closed end position. In this known telescopic rail there are no means present for coupling the intermediate section to the inner section during the extension movement.

In the telescopic rail according to the invention, preferably, the locking member can be shifted axially into the pass position by means of an unlocking stop, in which pass position the fingers can be moved resiliently towards each other and the projections of the inner section can pass the projections provided on the resilient fingers.

The unlocking stop is preferably connected to the second ball cage and mounted in the path of travel of the locking member, the unlocking stop causing the locking member to shift beyond the reach of the resilient fingers when the intermediate section is in its fully extended position.

In the retracted position of the telescopic rail, the locking member is preferably in abutment with a retaining member connected to the cabinet section, which retaining member can shift the locking member into the locking position. In this locking position, the inner section is retained by the edges of the retaining member.

One embodiment of the telescopic rail according to the invention will now be further explained and illustrated, by way of example, with reference to the accompanying drawings, in which.

Figure 1:
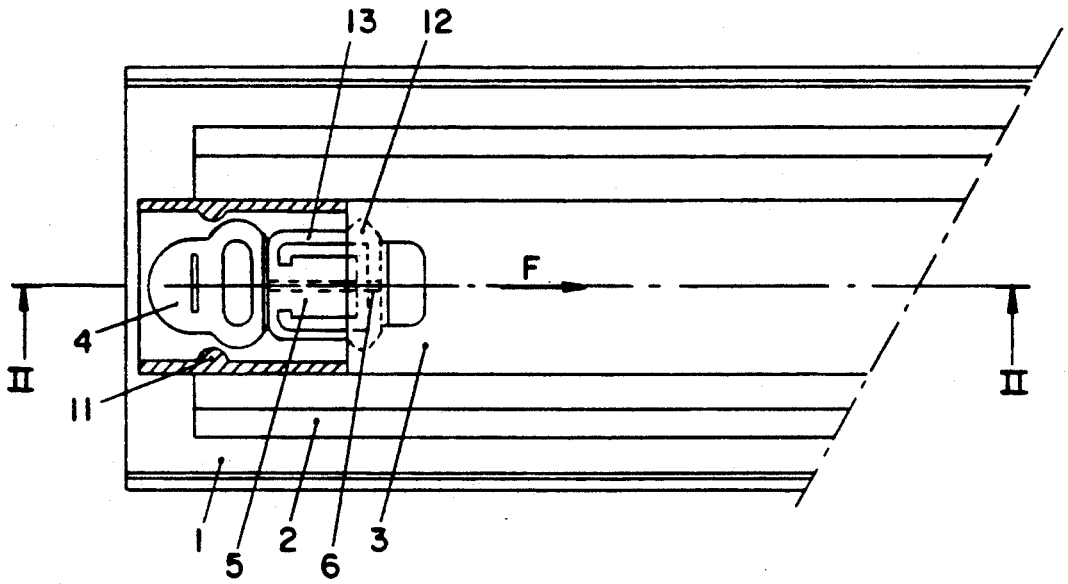
FIG. 1 is an elevational view of one end of a telescopic rail in the retracted condition.
Figure 2:
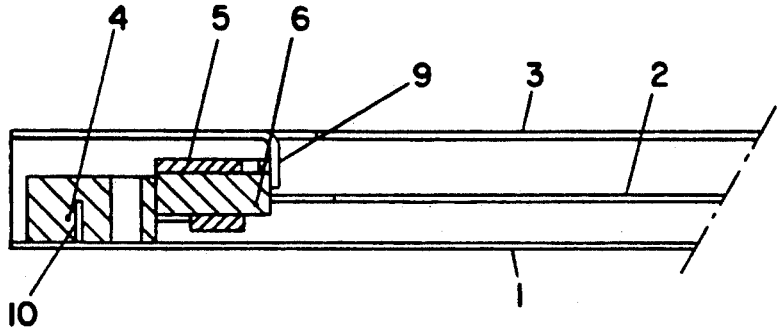
FIG. 2 is a section taken on the line II—II of FIG. 1.
Figure 3:
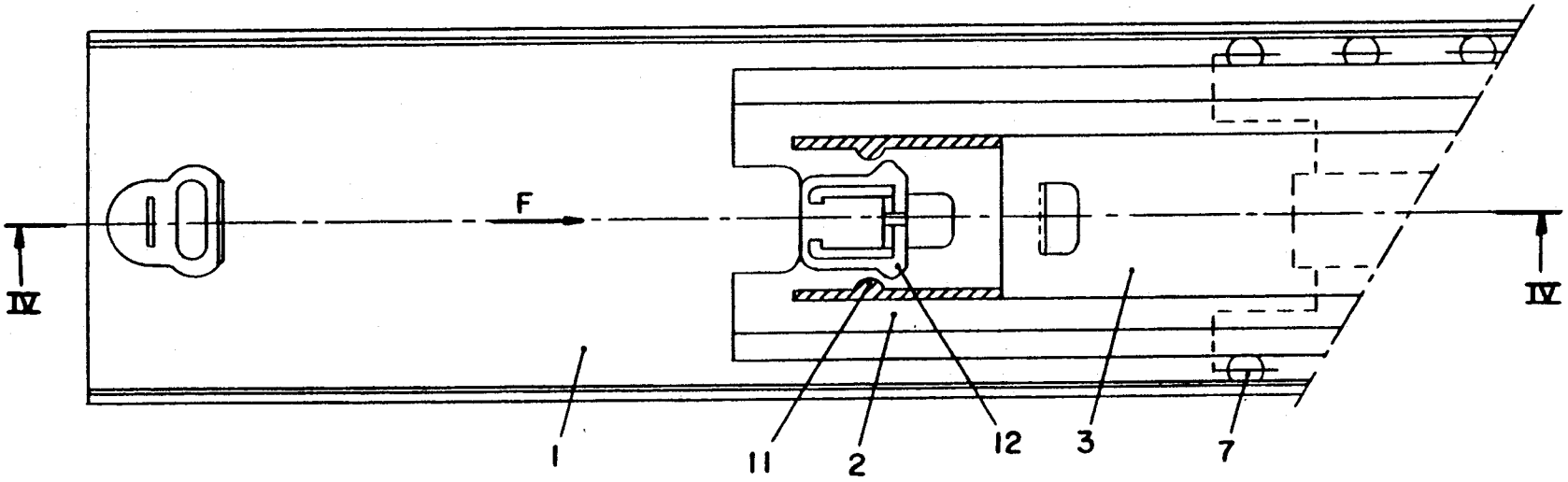
Figure 4:
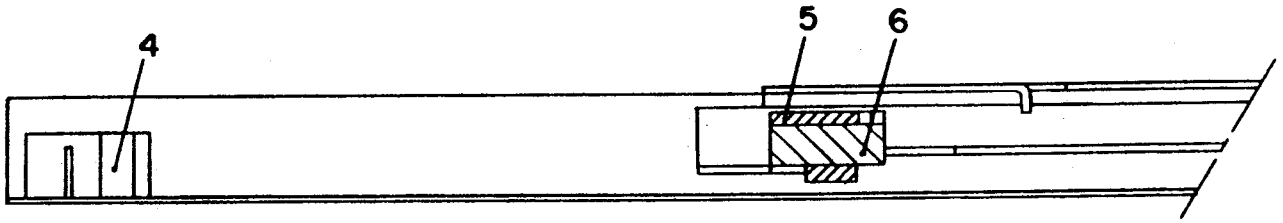
Figure 5:
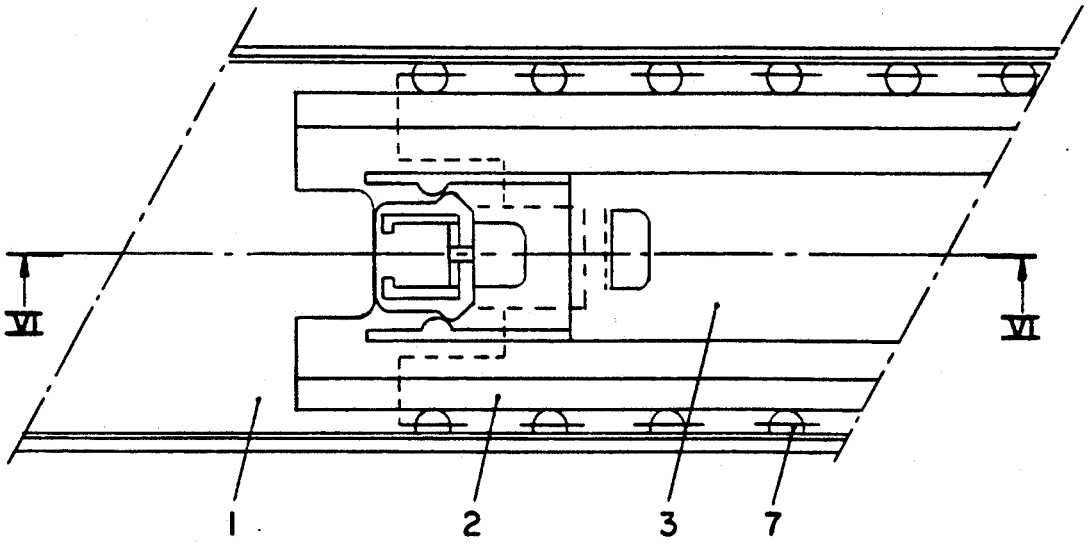
Figure 6:
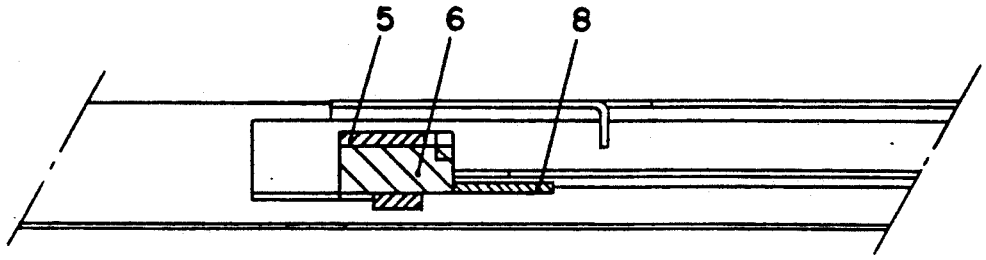
Figure 7:
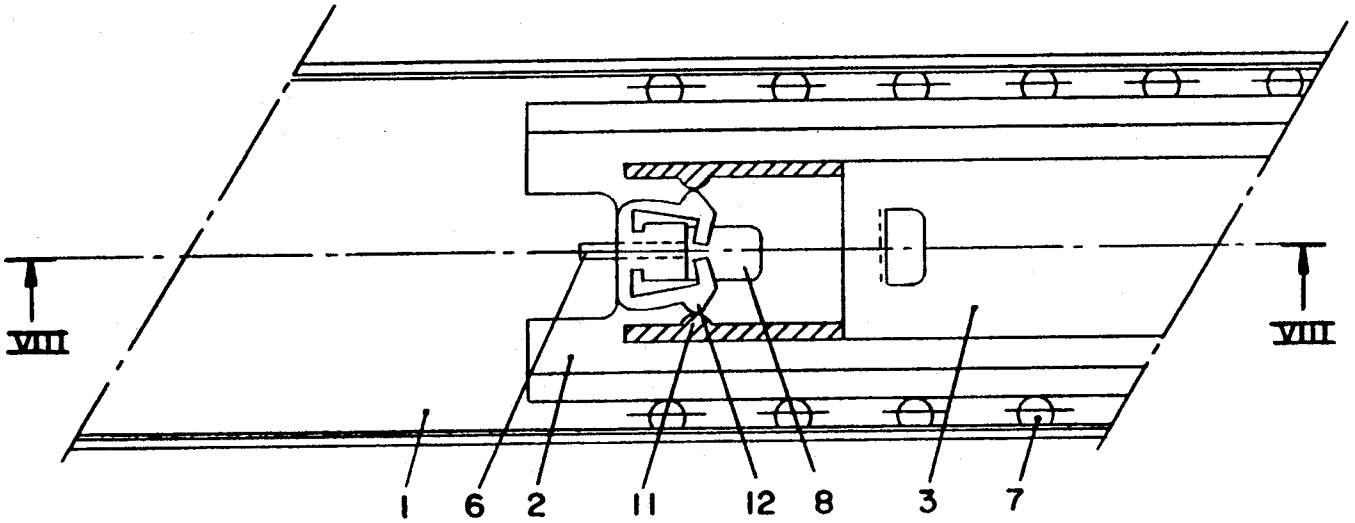
Figure 8:
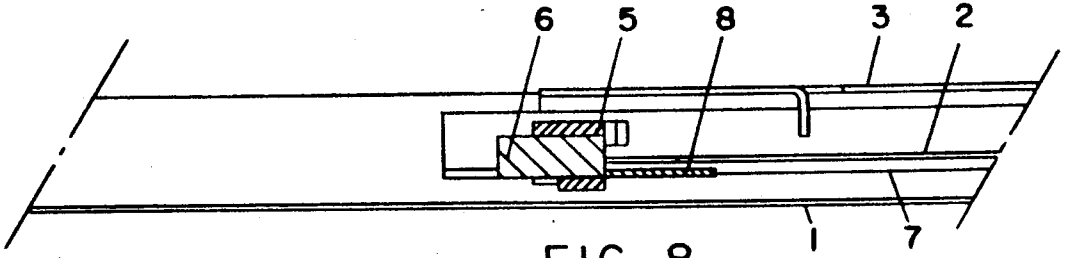

FIGS. 3, 5 and 7 are elevational views of a telescopic rail according to FIG. 1 in different positions during the extension movement thereof; and FIGS. 4, 6, and 8 are sections similar to FIG. 2 of the telescopic rail according to FIGS. 3, 5 and 7, respectively.

The telescopic rail as shown in FIGS. 1–2 consists of an outer or cabinet section 1, an intermediate section 2 and an inner or drawer section 3, the sections 2, 3 being extendable from the end position shown in FIG. 1 in the direction of extension F. Mounted between the sections 1, 2 and 2, 3 are ball cages, such as the ball cage 7 shown in FIG. 3, mounted between the outer section 1 and the intermediate section 2. The end position in the retracted condition of the drawer is determined by a bent lug 10 provided in the cabinet section 1, this lug 10 having fitted over it a plastics retaining member 4. In the end position, the stop block 5 mounted on the intermediate section 2 is in abutment with the retaining member 4 and a lug 9 provided in drawer section 3 is in abutment with the rearward end of the stop block 5. At its left-hand end the drawer section 3 is provided with inwardly pointing projections 11 facing each other, which projections are provided in the sidewalls of the drawer section 3 and which, in the end position of the telescopic rail, are confined by the side edges of the plastics retaining member 4 (see FIG. 1). The stop block 5 on the intermediate section 2 is made of plastics and fitted with resilient fingers 13 having provided thereon outwardly pointing projections 12 facing away from each other, which projections 12 can cooperate with the projections 11 in the drawer section 3 in a manner to be described hereinafter. Adjacent the centerline of the telescopic rail, the resilient fingers 13 abut a locking member 6 slidably mounted in the stop block 5 and retaining the resilient fingers 13 in a coupling position wherein the projections 11 cannot pass the projections 12 provided on the resilient fingers 13.

FIGS. 3 and 4 show the situation where the drawer connected to the drawer section 3 has been pulled outwardly over a short distance in the direction F. The projections 11 provided on the legs of drawer section 3 have passed the plastics retaining member 4 and subsequently abutted the projections 12 provided on the resilient fingers 13 of the stop block 5, so that the intermediate section 2 is pulled out along with the drawer section 3 in the direction of extension F. The resilient fingers 13 cannot move in the direction of the centerline of the telescopic rail because this is prevented by the locking member 6 present between the terminal ends of the legs 13.

The relative position of the sections 2, 3 shown in FIGS. 3–4 is maintained until the second ball cage 7 of the intermediate section 2 abuts against an end stop (not shown) provided in the outer section 1, the locking member 6 abutting an unlocking stop 8 (see FIG. 6). In that position, the locking member 6 is shifted in axial direction relative to the stop block 5 by the unlocking stop 8 which is connected to the second ball cage 7 and the terminal ends of the resilient fingers 13 are enabled to move towards each other, as shown in FIG. 7. Upon further extension of the drawer, the projections 12 provided on the resilient fingers 13 are pushed inwards by the projections 11 connected to the drawer section 3, so that the drawer section 3 can be extended further while the intermediate section 2 remains in its end position.

When sliding the drawer inwards, the drawer section 3 can initially move inwards while the intermediate section 2 remains stationary, until the lug 9 provided in the drawer section 3 (see FIG. 2) abuts against the rearward end of the stop block 5, so that the intermediate section 2 is moved along with section 3. The locking member 6 remains in the pass position shown in FIG. 7 until the forward end of the locking member 6 abuts the retaining member 4 disposed at a terminal end of the cabinet section 1. The locking mechanism 6 is then pushed back into the coupling position, so that the position shown in FIG. 1 is reached again.

Unlike the extension movement, the retraction movement is not a forced movement. Due to incidental conditions of friction, the intermediate section 2 may slide in first, followed by the drawer section 3. In that case, too, the end position as shown in FIG. 1 is reached where the projections 11 are disposed beyond the side edges of the retaining member 4 after having compressed these side edges during the retraction movement of the drawer, thereby damping shock and preventing the drawer's rebounding.

I claim:

1. A telescopic rail mainly consisting of three, substantially C-shaped sections of which the inner or drawer section (3) is slidably mounted in the intermediate section (2) with interposition of a first ball cage and the intermediate section (2) is slidably mounted in the outer or cabinet section (1) with interposition of a second ball cage (7), there being mounted at one end of the intermediate section (2) a stop block (5) with resilient fingers (13), which fingers (13) can be brought into a coupling position wherein the inner section (3) is coupled to the intermediate section (2) and into a pass position wherein the inner section (3) can move independently of the intermediate section (2), characterized in that the inner section (3) at one end thereof is provided with inwardly pointing projections (11) facing each other, while the resilient fingers (13) of the stop block (5) are fitted with outwardly pointing projections (12) facing away from each other, which projections (12) can be brought into the coupling position by means of a locking member (6) adapted to be slid between the free ends of the resilient fingers (13), in which coupling position the projections (12) of the resilient fingers (13) are disposed in the path of travel of the projections (11) of the inner section (3).

2. A telescopic rail according to claim 1, characterized in that the locking member (6) can be shifted axially into the pass position by means of an unlocking stop (8), in which pass position the fingers (13) can be moved resiliently towards each other and the projections (11) of the inner section (3) can pass the projections (12) provided on the resilient fingers (13).

3. A telescopic rail according to claim 2, characterized in that the unlocking stop (8) is connected to the second ball cage (7) and is arranged in the path of travel of the locking member (6), the unlocking stop (8) in the fully extended position of the intermediate section (2) causing the locking member (6) to shift beyond the reach of the resilient fingers (13).

4. A telescopic rail according to claim 2, characterized in that the locking member (6) in the retracted position of the telescopic rail abuts a retaining member (4) which can shift the locking member (6) into the locking position.

5. A telescopic rail according to claim 2, characterized in that the unlocking stop (8) is connected to the second ball cage (7) and is arranged in the path of travel of the locking member (6), the unlocking stop (8) in the fully extended position of the intermediate section (2) causing the locking member (6) to shift beyond the reach of the resilient fingers (13).

6. A telescopic rail according to claim 5, characterized in that the locking member (6) in the retracted position of the telescopic rail abuts a retaining member (4) which can shift the locking member (6) into the locking position.

7. A telescopic rail according to claim 1, characterized in that the locking member (6) in the retracted position of the telescopic rail abuts a retaining member (4) which can shift the locking member (6) into the locking position.

* * * * *